US008651490B2

(12) United States Patent
Lubin

(10) Patent No.: US 8,651,490 B2
(45) Date of Patent: Feb. 18, 2014

(54) MODIFIED POKER GAME SYSTEM AND METHOD

(75) Inventor: Daniel C. Lubin, Las Vegas, NV (US)

(73) Assignee: Lubin-Jones, LLC, Las Vegas, NV (US)

( * ) Notice: Subject to any disclaimer, the term of this patent is extended or adjusted under 35 U.S.C. 154(b) by 0 days.

(21) Appl. No.: 13/304,237

(22) Filed: Nov. 23, 2011

(65) Prior Publication Data

US 2012/0071229 A1 Mar. 22, 2012

Related U.S. Application Data

(63) Continuation-in-part of application No. 12/498,341, filed on Jul. 6, 2009, now Pat. No. 8,262,450.

(60) Provisional application No. 61/200,126, filed on Nov. 25, 2008, provisional application No. 61/137,597, filed on Aug. 1, 2008, provisional application No. 61/417,166, filed on Nov. 24, 2010.

(51) Int. Cl.
*A63F 1/00* (2006.01)

(52) U.S. Cl.
USPC ..... 273/292; 273/274; 463/13

(58) Field of Classification Search
USPC ..... 273/292, 274, 309; 463/13
See application file for complete search history.

(56) References Cited

U.S. PATENT DOCUMENTS

| | | | | |
|---|---|---|---|---|
| 7,004,467 | B2 * | 2/2006 | Lo | 273/292 |
| 7,641,198 | B2 | 1/2010 | Ko et al. | |
| 2003/0155713 | A1 * | 8/2003 | Jones et al. | 273/292 |

* cited by examiner

*Primary Examiner* — Benjamin Layno
(74) *Attorney, Agent, or Firm* — Howard & Howard Attorneys PLLC

(57) ABSTRACT

Systems, methods and apparatus for providing and conducting a wagering game which includes receiving a wager; generating a random initial hand of playing cards for one or more players and a dealer; comparing the initial dealer hand with a qualifying preset criteria, wherein the qualifying preset criteria includes a specific rank which the initial dealer hand must achieve; and responsive to the satisfaction of the qualifying preset criteria, dividing each initial hand of cards into two sub-hands of a preset amount of cards for the one or more players and the dealer, wherein the two sub-hands for any of the one or more players and the dealer must have a different rank in the underlying game; and providing a payout corresponding with the underlying game wager received if the player's two sub-hands are of a higher rank than the dealer's corresponding two sub-hands.

20 Claims, 3 Drawing Sheets

MODIFIED POKER GAME SYSTEM AND METHOD

CROSS-REFERENCE TO RELATED APPLICATIONS

This application claims the benefit of U.S. Provisional Patent Application No. 61/417,166 which was filed Nov. 24, 2010, and is a continuation of U.S. patent application Ser. No. 12/498,341, filed on Jul. 6, 2009, now U.S. Pat. No. 8,262,450 which corresponds with U.S. Provisional Application No. 61/137,597 filed Aug. 1, 2008 and U.S. Provisional Application No. 61/200,126 filed Nov. 25, 2008, all of the disclosures of which are incorporated herein by reference.

BACKGROUND OF THE INVENTION

1. Field of the Invention

The invention relates to systems and methods of providing, conducting and modifying wagering games. In particular, the invention relates to systems and methods for providing and conducting a modified Pai Gow poker game.

2. Description of the Related Art

Pai Gow is an Asian game based on the use of tiles arranged by each player into a two-tile high side and a two-tile low side, looking for higher ranking on each side of the two sides. The two-sided hand configuration has since been adapted to poker to create the game of Pai Gow poker.

Pai Gow poker uses a 53-card deck consisting of a standard 52-card deck plus a joker. The joker card used in standard Pai Gow poker is a "bug" card, as opposed to a wild card, meaning that it can only act as a fill-in card to complete a straight, a flush or a straight flush, or otherwise acts as the fifth ace when not used in a straight, a flush or a straight flush. However, in some localities, such as Southern California, a version of Pai Gow poker using a completely wild joker card is prevalent.

Players are dealt a seven-card hand that they arrange into a "short" side comprising two playing cards and a "long" side comprising five playing cards. The rules of standard poker define the ranking of hands. In yet another rule, the long side must have a higher poker ranking than the short side. If a player disobeys this rule, the player's hand is considered to be a foul, leading to the forfeiture of any wager. Typically, a gaming establishment has a set of rules mandating how its dealers must arrange their Pai Gow poker hands, known as the "house way."

The player's hand faces the dealer's hand. Where the players elect to bank against one another and, thus, finance the action against one another, the player's hand faces the banker's hand. In order to win, a player must have a short side and a long side that both beat the ranking of the banker's short side and long side (for purposes of simplicity, the discussion mostly assumes the banker is a dealer acting on behalf of a gaming establishment, also referred to here as the "house"). If the ranking of one of the player's two sides is identical to the ranking of the banker's corresponding side, an occurrence known as a "copy," the house wins if the other side of the house's hand has a higher ranking than that of the player's corresponding side. If the player has just one side of higher ranking than the banker's corresponding side, an occurrence known as a "push," then neither the house nor the player win.

When played as per the rules described above, Pai Gow poker is close to being a 50/50 game of chance. For this reason, casinos must charge a commission, generally 5%, against player wins in order to create a house edge covering their costs of operation (where a player is the banker, a 5% commission is generally charged against all player net winnings). The need to charge a commission in order to have an adequate house edge is naturally a drawback to the game of Pai Gow poker. It makes the game appear more overtly unfavorable to players, resulting in player dissatisfaction and avoidance of the game by potential players. Moreover, the time lost in calculating commissions is taken away from play, resulting in loss of revenue to casinos who, in principle, experience increased revenue from increased play. Also, the need for dealers to stop play in order to calculate commissions distracts them, resulting in increased dealer errors during play, thus reducing casino yields. Finally, the need to calculate commissions inevitably results in dealer miscalculations. To the extent such dealer miscalculations are in favor of players, the house loses revenue directly. To the extent such dealer miscalculations are in favor of the house, they risk provoking player dissatisfaction and mistrust. The prior art fails to disclose a Pai Gow poker game overcoming the need for a gaming establishment to charge the standard house commission on player winnings that pays even money on player wins.

Another problem endemic to Pai Gow poker is the relatively slow pace of the game. Since many Pai Gow poker hands are pushes where neither side wins, it will be appreciated that a Pai Gow poker game may go on for a long time without any exchange of money (action) occurring. From a gaming establishment's standpoint, such time equates to lost revenue, and it would be generally desirable to increase the speed of play.

It can thus be seen that there is a need for an improved Pai Gow poker game enabling gaming establishments to eliminate the standard house commission on player winnings while maintaining their house edge, along with methods of play, tangible aids to foster efficient and enjoyable play of the game, and embodiments in gaming machines, play over computer networks and tournament play, among other things.

SUMMARY OF THE INVENTION

The invention relates to systems and methods of providing, conducting and modifying wagering games.

Some embodiments of the invention are directed to a method of conducting a wagering game, which includes the steps of receiving a wager relating to the underlying wagering game; generating a random initial hand of at least eight playing cards in the underlying game for one or more players and a dealer; comparing the initial dealer hand with a qualifying preset criteria, wherein the qualifying preset criteria includes a specific rank which the initial dealer hand must achieve; responsive to the satisfaction of the qualifying preset criteria, dividing each initial hand of cards into two sub-hands of a preset amount of cards for the one or more players and the dealer, wherein the two sub-hands for any of the one or more players and the dealer must have a different rank in the underlying game; and providing a payout corresponding with the underlying game wager received if the player's two sub-hands are of a higher rank than the dealer's corresponding two sub-hands.

In some embodiments, the aforementioned method further includes returning the wager received as a push if the qualifying preset criteria are not achieved, a portion thereof or payout unequal to the wager received. In some embodiments, aforementioned method involves two sub-hands with one sub-hand having less cards than the other sub-hand, and other embodiments involve one of the two sub-hands being required to have a lower rank than the other sub-hand.

In some embodiments, the aforementioned method further includes the steps of: receiving a wager in an associated wagering game; comparing the initial player hand with an associated wagering game preset criteria, wherein the associated wagering game preset criteria relates to the initial hand achieving at least a specific poker rank; and providing a payout corresponding to the wager received if the associated wagering game preset criteria is satisfied.

In some embodiments, the aforementioned method further includes the steps of: receiving a wager in an associated wagering game; comparing the initial dealer hand with an associated wagering game preset criteria, wherein the preset criteria relates to the initial dealer hand achieving no greater than a specific poker rank; and providing a payout corresponding to the wager received if the associated wagering game preset criteria is satisfied.

In some embodiments, generating a random initial hand of playing cards in the underlying game involves using a program with a random number generator, but may also involve use of at least one randomly ordered deck of physical playing cards.

Some embodiments of the invention are directed to a system for conducting a wagering game, which includes a device, apparatus or other means for generating a random initial hand of playing cards in the underlying game for a player and a dealer; a processor configured for (i) comparing the initial dealer hand with a qualifying preset criteria, wherein the qualifying preset criteria includes a specific rank which the initial dealer hand must achieve; (ii) responsive to the satisfaction of the qualifying preset criteria, dividing each initial hand of cards into two sub-hands of a preset amount of cards for the one or more players and the dealer, wherein the two sub-hands for any of the one or more players and the dealer must have a different rank in the underlying game; and a communication interface configured for: (i) receiving a wager relating to the wagering game; and (ii) receiving instructions relating to the division of the initial hand into sub-hands; (iii) facilitating a payout corresponding with the wager received if the player's two sub-hands are of a higher rank than the dealer's corresponding two sub-hands.

The initial hand may be randomly generated through a random number generator or via randomly ordered playing cards. The communication interface may be a data input and/or data output device or a remote computer terminal, such as a home computer or mobile device with access to local or global network. The system and player interface may be configured for providing the associated wagering game to players via an online system or the Internet. The processor may also be remotely located from the player interface.

In some embodiments, the system further includes a display for presenting the underlying game. The player interface, processor and display device may be mounted within a unitary housing, and the aforementioned system may be an electronic gaming machine or electronic platform including multiple data input devices providing player positions.

DETAILED DESCRIPTION

Figure 1:
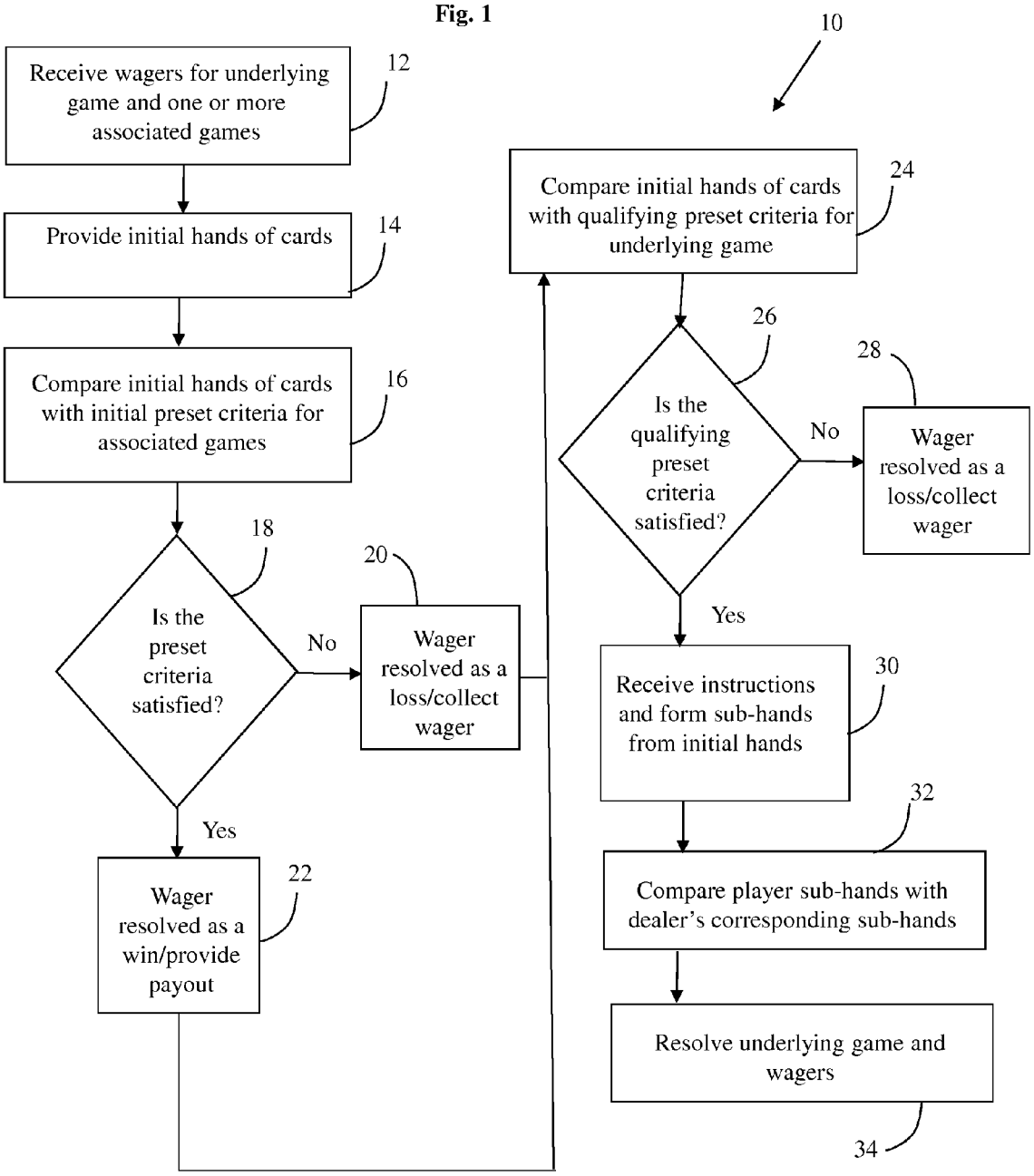
FIG. 1 is a process flow chart depicting an exemplary embodiment of the invention.

The exemplary embodiments herein relate to wagering games such as Pai Gow or poker variants and modifications thereof in which wagers are placed by players and received by the house or casino, or a person or entity acting as a banker of the game, that is, a dealer, to be subsequently resolved by, among other things, selections received from players and randomly generated events.

It should be understood that each of the methods and individual steps recited herein may be partially or wholly carried out in a variety of ways and/or systems, which may include, but are not limited to, a live dealer physically dealing playing cards in a casino, an electronic gaming machine (EGM) for use by one or more players, a multiplayer platform which may include a player interface such as a touchscreen display and involve physical or virtual playing cards, dealer and wagering chips, a home computer or portable computing device, such as a tablet computer or mobile phone capable of communicating with a network or over the Internet, global telecommunication network or world wide web. It should further be understood that the methods and systems of the invention are described herein in connection with a modified Pai Gow game for illustrative purposes only, as the methods and systems of the invention may be employed, combined or integrated with other games, such as poker based games.

All references herein that are made to "playing cards," "cards", "decks", "dealing", "hands of cards", "hands" or other such expressions that are ordinarily used in describing a wagering game that is played with physical playing cards are also meant to describe and encompass all associated electronic and online representations of said physical playing cards, including their associated graphical and numeric card symbols (for instance, suits such as hearts, spades, diamonds or clubs, face cards such as jacks, queens and kings, and the aces and other numbered cards of a typical playing deck). These expressions are also meant to extend as well to all forms of electronic dealing, distribution or allocation of the said card symbols, according to the rules of the underlying wagering game.

It should further be understood that the invention is directed to, among other things, methods of providing, conducting and resolving wagering games that include sequences of controlled and concrete transformative events. Some of these events may involve receiving wagers, receiving player decisions, wagering and resolving a wager, the generation and application of player decisions and random data to make transformations and comparisons according to preset criteria, which may include predefined game rules, and an ultimate determination of a final outcome. The generation of random data, which may comprise cards, can be facilitated by computerized and/or physical implements, such as playing cards. The transformative events may also include parsing of the data, either as generated or after application of a predefined set of game rules, for comparative purposes with preset criteria to determine an outcome in an underlying wagering game and wagering games associated therewith.

A method of providing, conducting and resolving a wagering game involving a comparison of preset criteria over a sequence of directed and defined transformative events of randomly generated results is generally referred to by the reference numeral 10 in FIG. 1.

In step 12, one or more wagers are received by a player interested in playing the wagering game and/or associated games. In this embodiment, wagers for the associated games are optional, and may be placed with a wager in the underlying game. However, in other embodiments, some or all of the wagers placed in step 12 may be mandatory, along with a wager placed in the underlying game.

In step 14, initial hands of randomly generated cards are dealt to form the respective initial player hand or players' hands and the initial dealer hand which defines a first transformative event. In an illustrative embodiment, each of the initial player hands and the initial dealer hand contain dealt eight cards.

In step 16, initial preset criteria are compared with the initial hands. The initial preset criteria may relate to a qualification for resolving the underlying game wager or any associated game wagers. Satisfaction of any qualification requirement (or the lack thereof), that is, qualifying preset criteria, is determined and applied, and/or respective associated game wagers received are considered and resolved to be won or lost. If applicable, an award may be paid or a wager received in step 12 may be collected, either immediately, after the qualification requirement is determined, or after the final outcome of the underlying game is determined.

In some embodiments, if the qualifying preset criteria are not satisfied then all wagers received in step 12 are resolved by being considered to have pushed, that is, they are returned to players. In some embodiments, an award is provided based on one or more of the wagers received in step 12, which may include the underlying game wager, such as a partial payout based on the unit wager received in step 12, should the qualifying preset criteria not be satisfied. For example, half the unit wager may be paid should the qualifying preset criteria not be satisfied.

In this embodiment, the initial preset criteria includes preset criteria for resolving associated game wagers and qualifying preset criteria for the underlying game wager. For purposes of illustration, the initial preset criteria for associated game wagers are compared with the initial hands for which such wagers were received in step 12 in steps 16 and 18. If none of the preset criteria for the associated game wager are satisfied in step 18, then the wagers are lost and collected in step 20. As shown by steps 18 and 22, should any preset criteria for the associated game wagers be satisfied, then the wager is won and payout is awarded.

The qualifying preset criteria are compared with the initial hands in step 24. In this embodiment the qualifying preset criteria relates to the rank of the dealer's initial hand, and in particular, to the dealer's initial hand having at least a specific poker rank or above. In some embodiments, the specific poker rank is a pair or greater, and may be based on three, four or five card poker hands for ranks such as a flush or straight. In other embodiments, the preset criteria is that the dealer's initial hand include at least a specific card, such as an Ace or King.

As shown by steps 26 and 28, if the initial qualifying preset criteria is not satisfied, then the underlying game ends and the underlying game wager is resolved. In this embodiment, only the underlying game wager received in step 12 is considered to have pushed, as shown in step 20, and any associated wagers received in step 12 which are capable of being resolved based on a comparison of the initial hands with the initial preset criteria relating to the associated wagering games, are resolved in step 22, while any other of the associated wagers not resolvable are lost or push. For example, a wager placed on an associated game of achieving at least a certain poker rank in the initial hand may be resolved by comparison with the initial preset criteria in steps 18 and 22.

If the initial qualifying preset criteria are satisfied in step 26, then the underlying game continues in step 30, as described below.

The comparison of initial hands with the initial preset criteria, including the qualifying preset criteria, and subsequent resolution or application thereof constitutes further transformative events.

In step 30, information is received regarding the cards in each of the initial hands being divided to form two or more final sub-hands of lesser cards than the initial hand, with each final sub-hand having a different rank according to the underlying game rules, that is, one or more final sub-hands of cards with a different rank from any other. For example, if the initial hand is divided into two hands, then a first final sub-hand may be a higher ranking hand than a second lower ranking final sub-hand. The dealer's final sub-hands may be formed pursuant to predefined rules in the underlying game. It should be readily apparent that step 30 which involves receiving information relating to the division of each of the initial hands of cards into two or more final sub-hands of lesser cards, each differing in rank, and which may include receiving each player's selections for their respective hands, constitutes an additional transformative event.

For example, in the illustrative embodiment described above in which each of the initial hands consist of eight cards, each initial hand of eight cards may therefore be divided into two final sub-hands of four cards and four cards, two final sub-hands of five cards and three cards, or two final sub-hands of six cards and two cards, provided that each final sub-hand differs in rank from another, in satisfaction of this step.

Alternatively, the initial hand may be divided into more than two final sub-hands, such as three final sub-hands of differing rank. As an illustration, if the initial hand is eight cards, then the initial hand may be divided into three final sub-hands consisting of four cards, three cards and one card or three final sub-hands consisting of three cards, three cards and two cards, for example. As a further illustration, if the initial hand is ten cards, then the initial hand may be divided into three final sub-hands consisting of five cards, three cards and two cards, or if the initial hand is nine cards, then three final sub-hands consisting of three cards each, for example, provided that all final sub-hands differ in rank in the underlying game.

In another alternative embodiment, the two or more final sub-hands of lesser cards than the initial hand may be formed by discarding one or more cards. As an illustration, if the initial hand is nine cards, then the initial hand may be divided into two final sub-hands of three cards and five cards, with one card being discarded, for example, either according to a selection made by player or according to a preset criterion or rule in the case of the dealer. As a further illustration, if the initial hand is eight cards, then the initial hand may be divided into two final sub-hands of two cards and five cards, with one card being discarded, for example.

The above notwithstanding, for purposes of illustrating the features of the invention, this embodiment will be further described in connection with an initial hand of eight cards being divided into two final sub-hands, a first final sub-hand consisting of five cards and a second final sub-hand consisting of three cards, wherein the first final sub-hand consisting of five cards must have a higher rank in the underlying game than the second final sub-hand consisting of three cards. Thus, for convenience sake, the first final sub-hand of five cards is referred to as the high hand while the second final sub-hand of two cards is referred to as the low hand.

In step 32, the final sub-hands for each player are compared with the corresponding final sub-hands for the dealer.

As shown in step 34, the underlying game and wager, including any associated game wagers which are resolvable based on the final outcome, are resolved. The final sub-hands are compared with the dealer's corresponding sub-hands to determine the final outcome of the underlying game and wager based on final preset criteria. In this embodiment, the final preset criteria sets forth the following relationships and resultant outcomes: if the player sub-hands are of a higher rank than the dealer's corresponding sub-hands, then the player wins the underlying game wager; if only one of the player sub-hands are of a higher rank than the dealer's corresponding sub-hand, then the underlying game wager is a push; and if one or both of the player sub-hands either tie in rank or are lower in rank than the corresponding dealer's sub-hands, then the underlying game wager is lost. In other embodiments, the final preset criteria may set forth relationships relating to the specific sub-hands. It should be readily apparent that step 34 further constitutes a transformative event.

In one exemplary embodiment, the initial hand consists of eight cards and is to be divided into a high hand of five cards and a low hand of three cards. The qualifying preset criteria relate to the dealer's initial hand having at least an Ace-high, that is, as a singleton. In other words, if there are five cards forming a flush or straight in the dealer's initial hand, the dealer will satisfy the qualifying preset criteria, but if the dealer has an initial hand with no discernable poker rank other than a King-high singleton, then the qualifying preset criteria will not be satisfied. The initial preset criteria for associated wagering game wagers (i.e., the associated wagering game preset criteria), may include the exemplary preset criteria shown in the following tables for which a player may optionally place a wager in a step such as step 12.

| Associated Wager Game Preset Criteria Satisfied by player's initial hand | Payout to wager |
|---|---|
| Royal flush (based on five cards), with Ace and Queen suited among the remaining cards | 1000 to 1 |
| Five Aces | 250 to 2 |
| Royal flush | 50 to 1 |
| Straight Flush | 25 to 1 |
| Four of a Kind | 10 to 1 |
| Full House | 5 to 1 |
| Flush | 3 to 1 |
| A-high Straight | 2 to 1 |

| Associated Wager Game Preset Criteria Satisfied by player's initial hand | Payout to wager |
|---|---|
| Ace-high singleton | 7 to 1 |
| King-high singleton | 25 to 2 |
| Queen-high singleton | 50 to 1 |
| Jack-high singleton | 110 to 1 |
| Ten-high singleton | 200 to 1 |

Wagers may also be received in step 12 for other associated wagering games which relate to the dealer's initial hand, and whether it will satisfy the qualifying preset criteria. For example, the associated wagering game preset criteria for comparison with the dealer's initial hand may be that the dealer's initial hand is a rank of King-high or less, and pay 40 to 1 for any wager received in connection with this associated game.

There may be other associated wagering game preset criteria which may be used in connection with the embodiments of the invention. It should be understood that payouts may be adjusted depending on the one or more preset criteria employed to, among other things, provide a desirable house advantage, and that the payouts may be a prize, fixed amounts, portions or all of a incremented progressive meter or some other item conferring benefit to the player.

Figure 2:
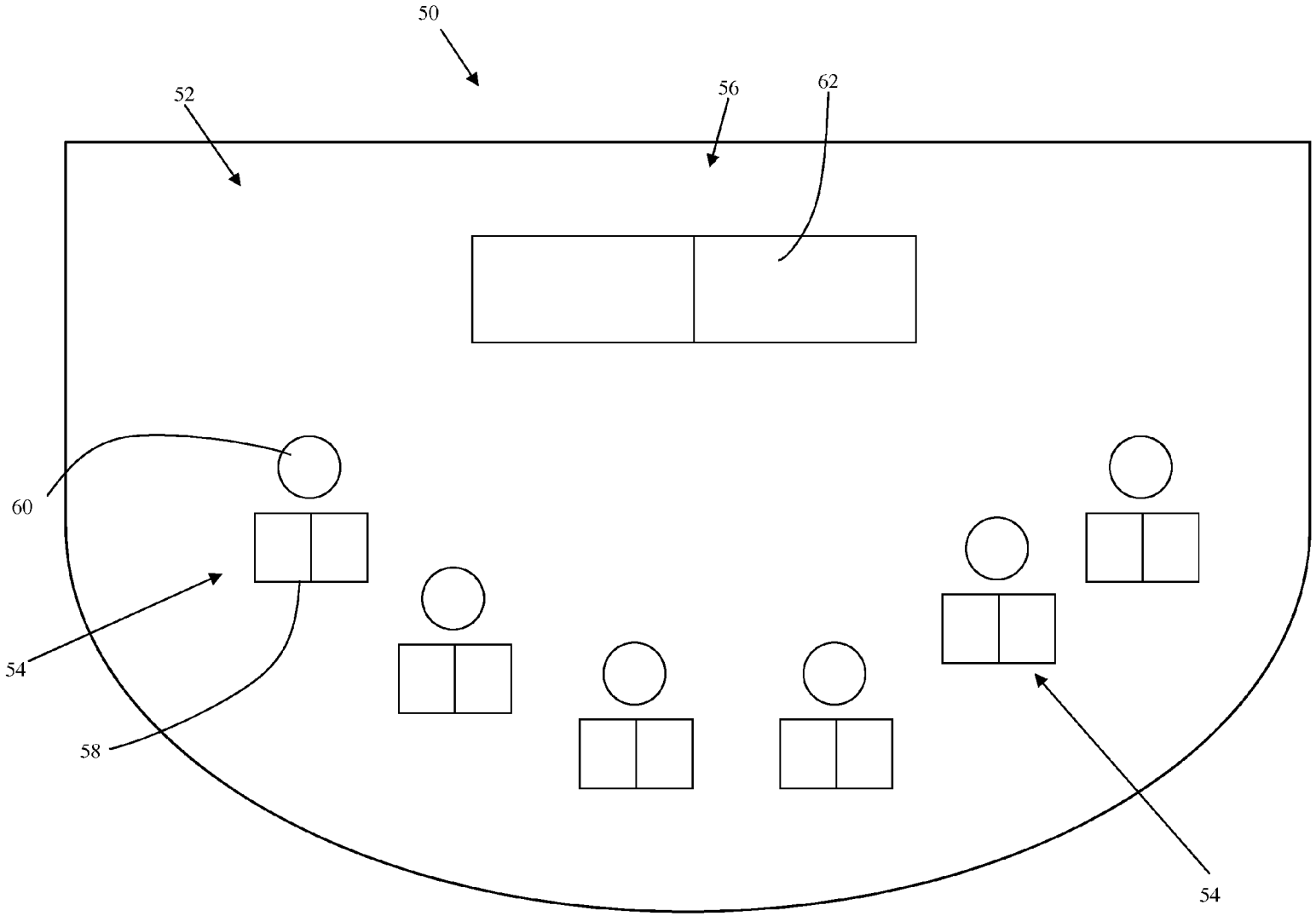
FIG. 2 is a schematic diagram of an exemplary table layout configured for use with methods according to some embodiments of the invention, including physical or live table systems and virtual or partially virtual electronic platforms.

FIG. 2 illustrates an exemplary system 50 configured for operating in accordance with embodiments of the invention, such as method 10. System 50 includes a layout 52 for use in facilitating the presentment and display of a method 10 and various embodiments thereof as described herein. Layout 52 may be a physical or virtual representation of a felt table display, as it should be understood that the methods of the invention would function as described herein if any one or more of the layout, cards, dealers or wagering chips or apparatus were virtually or physically represented. System 50 further includes multiple player positions or interfaces 54 accessible on layout 52 and a dealer position or interface 56. Each player position 54 includes a card receiving area 58 for receiving the initial hand and forming the sub-hands, and a wagering area 60 from which wagers on the underlying game and associated games may be placed and received. Dealer position 56 includes a card receiving area 62 for receiving the initial hand and forming the sub-hands if the initial hand satisfies the qualifying preset criteria.

Figure 3:
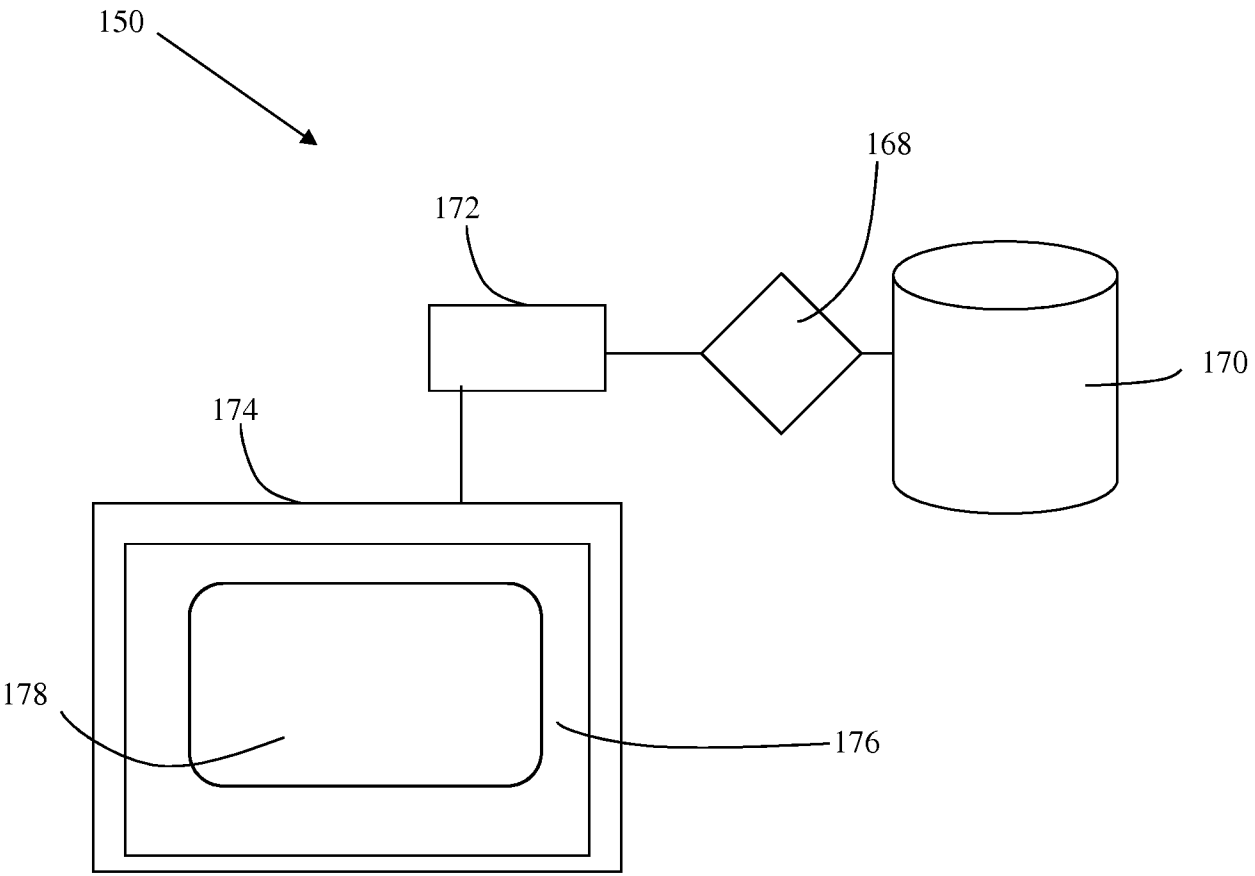
FIG. 3 is a schematic diagram of exemplary system components configured for use with methods according to some embodiments of the invention.

FIG. 3 illustrates an exemplary system 150 constructed in accordance with some embodiments of the invention. System 150 includes processing device 168 in communication with a database or memory device 170, communication or data input/output device 172 and a display device 174. In some embodiments, display device 174 is a touch-enabled device and includes a data input device component. Memory device 170 may include data relating to the underlying game and embodiments of the invention as described herein, such as the preset criteria. A player position 176 is displayed on display device 174 along with virtual representation of a layout and wagering area 178 for transmitting wagers in accordance with any of the embodiments herein, such as method 10. Game outcomes are displayed and wagers are tracked using display device 174 and processing device 168 compares the initial hand with the appropriate preset criteria, storing information relating to the satisfaction thereof in memory 170. Should the qualifying preset criteria be resolved and the game continue then the final preset criteria will be compared with the final sub-hands and if satisfied, a payout will be determined by processing device 168 and indicated on display device 174. If the preset criteria are not satisfied, the same is indicated on display device 174.

Those skilled in the art will readily appreciate that the methods described herein may be incorporated in a system in accordance with the invention using virtual representations of table layouts. The system of the invention may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as a mobile device. The system of the invention may be provided on electronic platforms with multiple player positions. In addition, the system of the invention may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the invention so long as players and operators thereof are provided with useful access thereto or the opportunity to provide and play the game as described herein.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth in the claims and equivalents thereto.

What is claimed is:

1. A method of conducting a wagering game over a communication network, comprising the steps of:

a) receiving a wager relating to a monetary amount at stake in the underlying wagering game through one or more player interfaces displayed on one or more communication devices in communication with the communication network;

b) responsive to receiving the wager, generating a random initial hand of at least eight playing cards for one or more players and a dealer for display on the one or more player interfaces;

c) comparing the initial dealer hand generated with a qualifying preset criteria, wherein the qualifying preset criteria includes a specific rank which the initial dealer hand generated must achieve, wherein the comparison of the initial dealer hand with qualify preset criteria is facilitated by at least one data processing device in communication with the communication network;

d) responsive to the satisfaction of the qualifying preset criteria, requesting instructions through the one or more player interfaces relating to the division of each initial hand generated into two sub-hands of a preset amount of playing cards for the initial hand of each of the one or more players and actuating the division of the initial hand of the dealer, wherein the resulting two sub-hands for any one of the one or more players and the dealer must have a different rank in the underlying game; and e) responsive to the receipt of information relating to the division of each initial hand, settling the wager received relating to a monetary amount at stake by providing a payout corresponding with the underlying game wager received for each player of the one or more players if a player's two sub-hands of playing cards are of a higher rank than the dealer's corresponding two sub-hands of playing cards, wherein the settling of the wager received is facilitated by the at least one data processing device in communication with the communication network.

2. A method according to claim 1, further comprising the step of returning the wager received as a push if the qualifying preset criteria is not achieved.

3. A method according to claim 1, further comprising the step of returning a portion of the wager received if the qualifying preset criteria is not achieved.

4. A method according to claim 1, wherein the division of the initial dealer hand is conducted according to predefined rules.

5. A method according to claim 1, further comprising the step of terminating the game responsive to the failure to satisfy the qualifying preset criteria.

6. A method according to claim 1, further comprising the steps of: receiving a wager in an associated wagering game through the one or more player interfaces; comparing the initial player hand with an associated wagering game preset criteria, wherein the preset criteria relates to the initial hand achieving at least a specific poker rank and the comparison is facilitated by the at least one processing device; and actuating the display of information on the one or more player interfaces relating to providing a payout corresponding to the wager received if the associated wagering game preset criteria is satisfied.

7. A method according to claim 1, further comprising the steps of: receiving a wager in an associated wagering game through the one or more player interfaces; comparing the initial dealer hand with an associated wagering game preset criteria, wherein the preset criteria relates to the initial dealer hand achieving no greater than a specific poker rank and the comparison is facilitated by the at least one processing device; and actuating the display of information on the one or more player interfaces relating to providing a payout corresponding to the wager received if the associated wagering game preset criteria is satisfied.

8. A system for conducting a wagering game, comprising:

a) means for generating a random initial hand of playing cards in the underlying game for a player and a dealer;

b) a processor configured for:

(i) comparing the initial dealer hand with a qualifying preset criteria, wherein the qualifying preset criteria includes a specific rank which the initial dealer hand must achieve;

(ii) responsive to the satisfaction of the qualifying preset criteria, dividing each initial hand of cards into two sub-hands of a preset amount of cards for the one or more players and the dealer, wherein the two sub-hands for any of the one or more players and the dealer must have a different rank in the underlying game; and c) a communication interface configured for:

(i) receiving a wager relating to the wagering game; and (ii) receiving instructions relating to the division of the initial hand into sub-hands;

(iii) facilitating a payout corresponding with the wager received if the player's two sub-hands are of a higher rank than the dealer's corresponding two sub-hands.

9. A system as recited in claim 8, wherein means for generating a random initial hand of playing cards in the underlying game for a player and a dealer is a processor.

10. A system as recited in claim 8, wherein means for generating a random initial hand of playing cards in the underlying game for a player and a dealer is at least one deck of randomly ordered playing cards.

11. A system as recited in claim 8, further comprising a display configured for displaying the outcome of the underlying game.

12. A system as recited in claim 8, wherein the communication interface and processor are mounted in a unitary housing.

13. A system according to claim 8, wherein the processor is remotely located from the communication interface.

14. A method of conducting an electronic wagering game, comprising the steps of:

a) receiving a wager through one or more communication interfaces relating to a monetary amount at stake in the underlying electronic wagering game;

b) responsive to receiving the wager, one or more processors generating a random initial hand for one or more players and a dealer, wherein the initial hand is communicated through the one or more communication interfaces;

c) the one or more processors comparing the initial dealer hand generated with a qualifying preset criteria stored in memory, wherein the qualifying preset criteria includes a specific rank which the initial dealer hand generated must achieve;

d) responsive to the satisfaction of the qualifying preset criteria, the one or more communication interfaces facilitating the division of each initial hand generated into two sub-hands of a preset amount of playing cards for the initial hands of the one or more players and the dealer, wherein the resulting two sub-hands for any one of the one or more players and the dealer must have a different rank in the underlying electronic wagering game; and e) responsive to the division of each initial hand, settling the wager received relating to a monetary amount at stake by providing a payout corresponding with the underlying game wager received for each player of the one or more players if a player's two sub-hands of playing cards are of a higher rank than the dealer's corresponding two sub-hands of playing cards.

15. A method according to claim 14, further comprising returning the wager received through the one or more communication interfaces as a push if the qualifying preset criteria is not determined to be achieved by the one or more processors.

16. A method according to claim 14, further comprising returning a portion of the wager received through the one or more communication interfaces if the qualifying preset criteria is not determined to be achieved by the one or more processors.

17. A method according to claim 14, wherein at least one of the two sub-hands is required to have less cards than the other sub-hand.

18. A method according to claim 14, wherein at least one of the two sub-hands is required to have a lower rank than the other sub-hand.

19. A method according to claim 14, wherein the division of the initial dealer hand is conducted according to predefined rules.

20. A method according to claim 14, further comprising the step of terminating the game responsive to the failure to satisfy the qualifying preset criteria.

* * * * *